US005739088A

United States Patent [19]

Inoue et al.

[11] Patent Number: 5,739,088

[45] Date of Patent: Apr. 14, 1998

[54] METHOD OF LUBRICATING AN ALCOHOL-BASED FUEL ENGINE WITH AN ENGINE OIL COMPOSITION

[75] Inventors: Kiyoshi Inoue; Takashi Mito, both of Kanagawa-ken; Masakuni Hirata, Tokyo, all of Japan

[73] Assignee: Nippon Oil Co., Ltd., Tokyo, Japan

[21] Appl. No.: 277,160

[22] Filed: Jul. 19, 1994

Related U.S. Application Data

[63] Continuation-in-part of Ser. No. 668,922, Mar. 13, 1991, abandoned.

[30] Foreign Application Priority Data

Mar. 14, 1990 [JP] Japan ..... 2-63741

[51] Int. Cl.[6] ..... C10M 125/26; C10M 139/00

[52] U.S. Cl. ..... 508/156; 508/186

[58] Field of Search ..... 252/49.7, 49.8, 252/46.4, 33.4; 508/186, 187, 197, 198, 156

[56] References Cited

U.S. PATENT DOCUMENTS

| | | | |
|---|---|---|---|
| 3,002,924 | 10/1961 | Sabol et al. | 508/187 |
| 3,776,847 | 12/1973 | Pearson | 252/33.4 |
| 3,813,337 | 5/1974 | Sheldahl | 252/33.4 |
| 3,829,381 | 8/1974 | Le Suer | 252/33.4 |
| 3,912,639 | 10/1975 | Adams | 252/49.7 |
| 3,912,643 | 10/1975 | Adams | 252/49.7 |
| 3,912,644 | 10/1975 | Adams | 252/49.7 |
| 4,119,549 | 10/1978 | Davis | 252/45 |
| 4,539,126 | 9/1985 | Bleeker et al. | 252/49.7 |
| 4,659,488 | 4/1987 | Vinci | 252/49.8 |
| 4,683,126 | 7/1987 | Inoue et al. | 508/186 |
| 5,380,508 | 1/1995 | Inoue et al. | 508/186 |

OTHER PUBLICATIONS

SAE Technical Paper Series, "The Effects of Alcohol Fuels and Fully Formulated Lubricants on Engine Wear"; H.W. Marbach, Jr., E.A. Frame, E.C. Owens and D. W. Naegeli, U.S. Army and Lubricants Research Lab, Southwest Research Institute, Fuels & Lubricants Meeting, Tulsa, Oklahoma, Oct. 19–22, 1981.

"Methanol–Capable Vehicle Development: Meeting The Challenge In The Crankcase" by W.B. Chamberlain, C.L. Gordon, Society of Automotive Engineers, Inc. (1990) pp. 1–13.

*Primary Examiner*—Margaret Medley

*Attorney, Agent, or Firm*—Ostrolenk, Faber, Gerb & Soffen, LLP

[57] ABSTRACT

An improvement in a method of lubricating an alcohol-based fuel engine with an engine oil composition, the improvement which comprises using as said composition an engine oil composition comprising a lubricating base oil and about 0.01 to 10% by weight based on the total weight of the engine oil composition of an alkaline-earth metal borate. Thus prepared engine oil compositions for alcohol-based fuel engines of the present invention are superior to the prior art compositions in capacity for neutralizing formic acid, wear resistance, and stability against hydrolysis.

12 Claims, No Drawings

METHOD OF LUBRICATING AN ALCOHOL-BASED FUEL ENGINE WITH AN ENGINE OIL COMPOSITION

This is a continuation-in-part of application Ser. No. 07/668,922, filed Mar. 13, 1991, now abandoned.

BACKGROUND OF THE INVENTION

1. Field of the Invention

This invention relates to a method of lubricating an alcohol-based fuel engines with a specific engine oil composition, and more particularly with an engine oil composition for alcohol-based, such as methanol- or ethanol-based, fuel engines.

2. Background Art

In alcohol-based fuel engines, for example, methanol-based fuel engines, oxidation products of alcohol such as formic acid and water are easily formed. A problem associated with the formation of such oxidation products has been the blowing of the production through the crankcase as a blow-by gas thus causing the crankcase to corrode and rust. Furthermore, these polar substances are the causes of wear of several parts of an engine. Therefore, it is necessary to neutralize the formic acid immediately after it enters into the engine oil to deactivate the acid. For the purpose, an overbasic detergent prepared by use of calcium carbonate has been used in conventional engine oils. However, the capacity of such a conventional overbasic detergent for neutralizing formic acid is insufficient, and said detergent has a tendency to become a coarse-grained particle during use. Furthermore, its wear resistance is also unsatisfactory.

The present invention is based on a discovery whereby efficient results can be attained employing an alkaline-earth metal borate instead of the conventional overbasic detergents.

The present invention provides for a method of lubricating an alcohol-based engine with an engine oil composition for alcohol-based fuel engines containing an overbasic detergent having improved capacity for neutralizing formic acid, improved wear resistance and no tendency to form coarse-grained particles during use.

SUMMARY OF THE INVENTION

The present invention provides a method of lubricating an alcohol-based fuel engine with an engine oil composition, the improvement which comprises using as said composition an engine oil composition comprising a lubricating base oil and about 0.01 to 10% by weight based on the total weight of the composition of an alkaline-earth metal borate as an essential component.

DETAILED DESCRIPTION OF THE PREFERRED EMBODIMENTS

Either mineral oils or synthetic oils may be used as the lubricating base oils of the present invention. Any paraffinic or naphthenic lubricating base oils may be acceptable wherein said base oils are manufactured by a process consisting mainly of topping of crude oil followed by vacuum distillation to give a lubricating oil fraction, and refining said lubricating fraction by a process selected from the group consisting of solvent deasphalting, solvent extraction, hydro-cracking, solvent dewaxing, catalytic dewaxing, hydro-refining, sulfuric acid treating, and clay treating. The synthetic oils of the present invention include, for example, α-olefin polymers (polybutenes, octene-1 oligomers, decene-1 oligomers, and the like), alkylbenzenes, alkylnaphthalenes, diesters (ditridecyl glutarate, di-2-ethylhexyl adipate, diisodecyl adipate, ditridecyl adipate, di-3-ethylhexyl sebacate, and the like), polyol esters (trimethylpropane caprylate, trimethylolpropane pelargonate, pentaerythritol-2-ethylhexanoate, pentaerythritol pelargonate, and the like), polyoxyalkylene glycol, polyphenyl ether, silicon oils, perfluoroalkyl ethers, and mixture thereof.

Preferred kinematic viscosity of these lubricating base oils is in a range of about 3 to 20 cSt at 100° C.

Alkaline-earth metal borates of the present invention have a general formula of $MO.xB_2O_3$ wherein M is an alkaline-earth metal atom, and x is positive having a value of 0.5 to 3.0. The alkaline-earth metals include magnesium, calcium, barium, with calcium being preferred. The alkaline-earth metal borates have a particle size of less than about 0.1 μm, preferably less than about 0.05 μm, more preferably less than about 0.02 μm. Although alkaline-earth metal borates in pure state can be used, so-called overbasic alkaline-earth metal borates (hereinafter referred to as "alkaline-earth metal borate dispersions") prepared by reacting oil-soluble metal salts with alkaline-earth metal borates may also be utilized in the present invention. The alkaline-earth metal borate dispersions have a total base number (measured by the procedure prescribed by JIS K 2501 5.2.3) of more than 100, preferably more than 170. The alkaline-earth metal borate dispersions are prepared by a reaction of an oil-soluble metal salt such as an oil-soluble neutral alkaline-earth metal sulfonate, oil-soluble neutral alkaline-earth metal salicylate, oil-soluble neutral alkaline-earth metal phenate, or oil-soluble neutral alkaline-earth metal phosphonate with an oxide or a hydroxide of an alkaline-earth metal in the presence of boric acid.

As oil-soluble neutral alkaline-earth metal sulfonate, an alkyl aromatic sulfonic acid having a molecular weight of about 300 to 400 can be used in the present invention. The alkyl aromatic sulfonic acids include petroleum sulfonic acid or synthetic sulfonic acids such as monoalkylbenzene sulfonic acid, and dialkylbenzene sulfonic acid, dinonylnaphthalene sulfonic acid.

Among oil-soluble metal salts, alkaline-earth metal salicylates are most appropriate.

As a hydroxide or oxide of an alkaline-earth metal, magnesium hydroxide, calcium hydroxide, barium hydroxide, magnesium oxide, calcium oxide and barium oxide can be used in the present invention. The alkaline-earth metal contained in a hydroxide or oxide of an alkaline-earth metal may be the same as, or different from, that contained in the oil-soluble metal salt.

Although the quantity of the hydroxide or oxide of an alkaline-earth metal used in the reaction step can be selected optionally, it is normally 10–200 parts by weight, preferably 20–100 parts by weight, per 100 parts by weight of the oil-soluble metal salt.

As boric acid, orthoboric acid, metaboric acid, tetraboric acid and boric anhydride can be used. Generally orthoboric acid is desirable. Although the amount of boric acid used in the reaction step can be selected optionally, it is normally 0.5 to 6.5 moles, desirably 1.0 to 6.0 moles per mole of an oxide or a hydroxide of an alkaline-earth metal.

Any method for preparing the alkaline-earth metal borate dispersions may be acceptable. For example, a method has been known which comprises reacting an oil-soluble metal salt aforesaid, a hydroxide or an oxide of alkaline-earth metal, and boric acid in the presence of water, an alcohol, and a diluent.

Although the quantity of water used in the reaction step can be selected optionally, it is normally 1–50 parts by weight, preferably 2–40 parts by weight, more preferably 15–20 parts by weight, per 100 parts by weight of an oil-soluble metal salt.

As an alcohol, an alkanol normally having 1 to 4 carbon atoms can be used. A desirable alcohol is a monoalkanol or a dialkanol, and examples thereof include methanol, ethanol, propanol, butanol, ethylene glycol, propylene glycol, triethylene glycol, butylene glycol, tetramethylene glycol, and mixtures thereof. Although the amount of alcohol used in the reaction step can be selected optionally, it is normally 20–1000 parts by weight, desirably 60–600 parts by weight, per 100 parts by weight of an oil-soluble metal salt.

As a diluent, a nonpolar organic solvent of a boiling point of 60° C. or higher can be usually used. Examples of the diluent include aromatic hydrocarbons such as benzene, toluene and xylene, petroleum-derived solvents such as benzene, ligroin, mineral spirit and cleaning solvents and a gasoline fraction, a kerosene fraction, a gas oil fraction and a lubricating oil fraction of a mineral oil. Although the amount of a diluent used in the reaction step of the present invention can be selected optionally, it is normally 40 to 1000 parts by weight, desirably 200 to 600 parts by weight, per 100 parts by weight of an oil-soluble metal salt.

In the reaction step of the present invention, specified amounts of the above-mentioned components, i.e., an oil-soluble metal salt, a hydroxide or an oxide of alkaline-earth metal, and boric acid in the presence of water, an alcohol, and a diluent, are reacted with each other under through agitation at a reaction temperature of normally 20° to 200° C., desirably 20° to 100° C., more desirably 40° to 95° C. In this invention, the reaction is desirably carried out at atmospheric pressure at the above-mentioned reaction temperature range. Although the reaction time an be determined optionally, it is normally 2 to 8 hours, desirably 3 to 5 hours.

The reaction mixture obtained in this way is subjected to the subsequent distillation step. While agitating the reaction mixture, the system is heated to normally 100° to 200° C., desirably 110° to 160° C., and kept at that temperature for usually 1 to 2 hours to remove the water from the system. In this distillation step, the water added in the reaction step and the water formed by the reaction can be removed while the extent of hydration of the formed alkaline-earth metal borate can be suitably regulated. It is also possible to remove part of the alcohol or the diluent or the both in this step, if required.

The alkaline-earth metal borate dispersions obtained by the process of the present invention usually contain 5 to 30% by weight of the alkaline earth metal borate.

Further the alkaline earth metal borate dispersion has a boron to alkaline-earth metal molar ratio as high as about 0.8 to 6% according to the overall compositional analysis.

The reaction conditions may be employed suitably depending on the raw materials to be used, the amount of reactants and the like. Typical of such prior art practices are those disclosed in Japanese Patent Publication No. 61-204298 and the disclosure of which is incorporated by reference. In general, the alkaline-earth metal borate dispersions obtained by the above-mentioned procedures have a particle size of less than 0.1 μm and a total base number of more than about 100, and are appropriate for the present invention.

A content of the alkaline-earth metal borate in the present composition is in an amount of 0.01 to 10% by weight, preferably 0.05 to 3% by weight, more preferably about 0.05 to 1% by weight, on the basis of the total amount of the composition.

When the content is less than about 0.01% by weight, there is no merit to the use of the alkaline-earth metal borate. Inversely, when it is in excess of 10% by weight, the amount of sulfated ash is increased unpreferably.

In the present invention, the following conventional lubricating oil additives can be additionally used to improve further the performance of the present composition if necessary, insofar as they do not deviate from the gist of the present invention. Examples of these additives include oiliness improvers such as higher alcohols, higher fatty acids, esters and the like; extreme pressure agents and friction modifiers such as tricresyl phosphate, triphenyl phosphate, zinc dithiophosphates, molybdenum disulfides, molybdenum dithiophosphates, molybdenum dithiocarbamates and the like; rust preventives such as petroleum sulfonates, dinonyl naphthalene sulfonates and the like; metal deactivating agents such as benzotriazole and the like; metal-based detergents such as alkaline-earth metal sulfonates, alkaline-earth metal salicylates, alkaline-earth metal phenates, alkaline-earth metal phosphonates and the like; ashless dispersants such as succinimide, succinic esters, benzylamine and the like; deformers such as silicon oils and the like; viscosity index improvers and pour point depressants such as polymethacrylates, polyisobutylenes and polystyrenes and the like; antioxidants such as zinc dithiophosphates, hindered phenols, aromatic amines and the like; and mixture thereof. The content of the viscosity index improver is in an amount of about 1 to 30% by weight, the deformer is in an amount of about 0.0005 to 1% by weight, the metal deactivating agent is in an amount of about 0.005 to 1% by weight, and other additives is in an amount of about 0.1 to 15% by weight, respectively, on the basis of the total amount of the composition.

The engine oil compositions for alcohol-based fuel engines of the present invention are suitable for spark-ignition or compression-ignition engines in which said alcohol-based fuel is selected from the group consisting mainly of methanol, ethanol, propanol, mixtures thereof, and the mixture of at least 10% by volume of one of these alcohols with a petroleum-based fuel such as gasoline, kerosene, and gas oil.

While the advantages of the compositions according to the present invention will be described in detail hereinbelow in conjunction with the following examples, it is to be noted that the scope of the present invention should not be limited to these examples.

EXAMPLES 1–2 AND COMPARATIVE EXAMPLES 1–2

In order to measure the capacity for neutralizing formic acid of the present compositions, engine oil compositions were prepared by blending an overbasic oil-soluble metal salt prepared by use of calcium borate in an amount shown in Table 1 with a refined mineral oil (SAE 30, 10.0 cSt at 100° C.). Formic acid in an amount shown in Table 1 was added individually to these compositions and pH of these compositions after 30 sec. were measured. Table 1 gives the results. For reference, the same procedures were repeated except that calcium carbonate was used to prepare the overbasic oil-soluble metal salt, and the results are also shown in Table 1.

TABLE 1

| | Example 1 | Example 2 | Comparative Example 1 | Comparative Example 2 |
|---|---|---|---|---|
| Oil-soluble metal salts (Detergents) | Calcium borate-sulfonate[1)] | Calcium borate-salicylate[2)] | Calcium carbonate-sulfonate[3)] | Calcium carbonate-salicylate[4)] |
| Content of Calcium borate or carbonate (wt. %) | 1.05 | 0.84 | 0.88 | 0.70 |
| pH | | | | |
| Conc. of formic acid | | | | |
| 25% | 8.14 | 8.25 | 7.20 | 7.18 |
| 50% | 7.94 | 8.04 | 6.74 | 6.60 |
| of neutralization eq. | | | | |

[1)]Overbasic calcium sulfonate prepared by use of calcium borate, containing 7.6% of Ca, having a total base number of 180.
[2)]Overbasic calcium salicylate prepared by use of calcium borate, containing 7.0% of Ca, having a total base number of 180.
[3)]Overbasic calcium sulfonate prepared by use of calcium carbonate, containing 12.0% of Ca, having a total base number of 310.
[4)]Overbasic calcium salicylate prepared by use of calcium carbonate, containing 6.6% of Ca, having a total base number of 176.
*The base number of the lubricating oil composition (containing neutral salt, overbasic particles, diluent oil) is 7.0.

EXAMPLES 3–5 AND COMPARATIVE EXAMPLES 3–5

In order to measure the wear resistance of the present compositions, engine oil compositions were prepared by blending 2% by weight, on the basis of the total amount of the composition, of overbasic oil-soluble metal salt prepared by use of calcium borate with a refined mineral oil (SAE 10, 4.3 cSt at 100° C.). The tests were carried out by the high-speed pour point ball method. The test conditions were as follows:

Test load 30 Kg.

Engine speed 1200 r.p.m.

Test duration 30 min.

Table 2 shows the test results. For reference, the same procedures were repeated except that calcium carbonate was used to prepare the overbasic oil-soluble metal salt, and the results are also shown in Table 2.

TABLE 2

| | Example 3 | Example 4 | Example 5 | Comparative Example 3 | Comparative Example 4 | Comparative Example 5 |
|---|---|---|---|---|---|---|
| Oil-soluble metal salts (Detergents) | Calcium borate-sulfonate | Calcium borate-salicylate | Calcium borate-phenate[1)] | Calcium carbonate-sulfonate | Calcium carbonate-salicylate | Calcium carbonate-phenate[2)] |
| Content of Calcium borate or carbonate (wt. %) | 0.54 | 0.43 | 0.43 | 0.75 | 0.36 | 0.60 |
| Average scratches (mm.) | 0.42 | 0.38 | 0.42 | 0.49 | 0.59 | 0.52 |

[1)]Overbasic calcium phenate prepared by use of calcium borate, containing 7.0% of Ca, having a total base number of 180.
[2)]Overbasic calcium phenate prepared by use of calcium carbonate, containing 9.6% of Ca, having a total base number of 250.

EXAMPLES 6–8 AND COMPARATIVE EXAMPLES 6–8

In order to measure the stability against hydrolysis of the present compositions, the engine oil compositions of the present invention were prepared by blending 15% by weight, on the basis of the total amount of the composition, of an overbasic oil-soluble metal salt prepared by use of calcium borate with a refined mineral oil (SAE 10, 4.3 cSt at 100° C.). The tests were carried out by the method prescribed by ASTM D 2619. Table 3 gives the test results. For reference, the same procedures were repeated except that calcium carbonate was used to prepare the overbasic oil-soluble metal salt, and the results are also shown in Table 3.

TABLE 3

| | Example 6 | Example 7 | Example 8 | Comparative Example 6 | Comparative Example 7 | Comparative Example 8 |
|---|---|---|---|---|---|---|
| Oil-soluble metal salts (Detergents) | Calcium borate-sulfonate | Calcium borate-salicylate | Calcium borate-phenate | Calcium carbonate-sulfonate | Calcium carbonate-salicylate | Calcium carbonate-phenate |
| Content of Calcium borate or carbonate (wt. %) | 4.06 | 3.24 | 3.24 | 5.66 | 2.70 | 4.52 |
| Ratio of base number[1)] | 0.94 | 0.93 | 0.97 | 0.71 | 0.88 | 0.70 |
| Sludge (mm/g) | 0.3 | 1.6 | 1.5 | 2.5 | 5.6 | 4.1 |

[1)]Ratio = base number after test/base number before test (hydrochloric acid method).

Preparation of Calcium Borate-sulfonate of Examples 1, 3 & 6

One hundred parts by weight of synthetic neutral calcium sulfonate (dissolved in 100 parts by weight of a lubricating oil fraction), 32 parts by weight of calcium hydroxide, 53.6 parts by weight of boric acid (2.0 times that (in mol) of the calcium hydroxide), 20 parts by weight of water, and 20 parts by weight of cleaning solvent having a boiling point range of 150°–175° C., were mixed and reacted with through stirring under an atmospheric pressure at a reaction temperature of 85° C. for 4 hours. The resulting reaction mixture was then heated to elevate the temperature of the system to 120° C. and maintained at this temperature with stirring for 1 hour, thereby to remove the water and a part of the solvent, i.e. cleaning solvent, out of the system.

The reaction mixture was then filtered out to obtain a dispersion of calcium borate (calcium borate-sulfonate) as the filtrate.

This calcium borate dispersion contained 24% by weight of calcium borate (including hydration wator), and the entire dispersion had the following analysis:

| | |
|---|---|
| Ca | 7.6% by weight |
| S | 1.6% by weight |
| B | 3.8% by weight |
| B/Ca | 1.83 (molar ratio) |
| Total base value | |
| (hydrochloric acid method) | 180 |
| (perchlorate method) | 175 |

The total base number was measured in accordance with JIS K2501 5.2.2 "Potential Difference Titration Method" (hydrochloric acid method) and JIS K2501 5.2.3. "Potential Difference Titration Method" (perchlorate method). The calcium borate in this calcium borate dispersion had an average composition of $CaO.B_2O_3.2H_2O$ and an average particle size of 100–200 angstrom.

Preparation of Calcium Borate-salicylate of Examples 2, 4 & 7

A solution of 100 parts by weight of a neutral calcium alkyl-salicylate in 100 parts by weight of a lubricating oil fraction, 24 parts by weight of calcium hydroxide, 40 parts by weight (2.0 moles per mole of the calcium hydroxide) of orthoboric acid and 400 parts by weight of xylene were put in a 1000-ml four-necked flask fitted with a condenser and heated to 40° C. under agitation. To this mixture were added 60 parts by weight of methanol and 10 parts by weight of water and the resulting mixture was heated under agitation to the reflux temperature (60° C.) and reacted for 3 hours. The reaction mixture was further heated to 140° C. to distil out the methanol, water and xylene. Finally the reaction product was diluted twofold with hexane and filtered, and the hexane was distilled out to leave the desired calcium borate overbased alkyl-salicylate (calcium borate-salicylate).

This alkyl-salicylate had the following analytical values:

| | |
|---|---|
| Ca | 7.0 wt. % |
| B | 3.1 wt. % |
| total base number | 180 (JIS K2501 5.2.3) |

Preparation of Calcium Borate-phenate of Examples 5 and 8

A solution of 100 parts by weight of a neutral calcium alkyl-phenolate in 100 parts by weight of a lubricating oil fraction, 24 parts by weight of calcium hydroxide, 40 parts by weight (2.0 moles per mole of the calcium hydroxide) of orthoboric acid and 400 parts by weight of xylene were put in a 1000-ml four-necked flask fitted with a condenser and heated to 40° C. under agitation. To this mixture were added 200 parts by weight of methanol and 0.5 parts by weight of water and the resulting mixture was heated under agitation to the reflux temperature (66° C.) and reacted for 3 hours. The reaction mixture was further heated to 140° C. to distil out the methanol, water and xylene. Finally the reaction product was diluted twofold with hexane and filtered, and the hexane was distilled out to leave the desired calcium borate overbased alkyl-phenolate (calcium borate-phenate).

This alkyl-phenolate had the following analytical values:

| | |
|---|---|
| Ca | 7.0 wt. % |
| B | 1.4 wt. % |
| total base number | 180 (JIS K2501 5.2.3) |

As is apparent from the results shown in Tables 1 to 3, the engine oil compositions for alcohol-based fuel engines of the present invention are superior to the prior art compositions in capacity for neutralizing formic acid, wear resistance, and stability against hydrolysis.

What is claimed is:

1. In a method of lubricating an alcohol-based fuel engine with an engine oil composition, the improvement which comprises using as said composition an engine oil composition comprising a major amount of mineral oil or synthetic oil or mixture thereof as a lubricating base oil and about 0.01 to 10% by weight based on the total weight of the engine oil composition of an alkaline-earth metal borate which is the reaction product of an oil-soluble neutral metal salt with an oxide or a hydroxide of an alkaline-earth metal in the presence of boric acid or boric acid anhydride and in which said oil-soluble neutral metal salt is selected from the group consisting of an oil-soluble alkaline-earth metal neutral sulfonate, an oil-soluble alkaline-earth metal neutral salicylate and oil-soluble alkaline-earth neutral phenate and in which said borate has a base number greater than 100 and a particle size of less than about 0.1 μm.

2. The method of claim 1 in which the alkaline-earth metal is magnesium, calcium or barium.

3. The method of claim 1 in which the particle size is less than about 0.05 μm and the base number is greater than 170 and the borate is present in an amount of about 0.05–1%.

4. The method of claim 1 in which said oil-soluble neutral metal salt is an oil-soluble alkaline-earth metal salicylate.

5. The method of claim 1 in which the alkaline-earth neutral metal borate is the reaction product of an oil-soluble metal neutral salt, an oxide or a hydroxide of an alkaline-earth metal, and boric acid or boric acid anhydride in the presence of water, and alcohol, and a diluent.

6. The method of claim 5 in which said alcohol is selected from methanol, ethanol, propanol or butanol.

7. The method of claim 5 in which said diluent is selected from the group consisting of benzene, toluene, or xylene.

8. The method of claim 5 in which the reaction product was made at a reaction temperature of about 20° C. to about 200° C.

9. The method of claim 5 in which the reaction product was made utilizing a reaction time of about 2 to 8 hours.

10. The method of claim 5 in which the reaction product was distilled by heating the mixture at about 100° C. to about 200° C.

11. The method of claim 3 in which said borate has a particle size of less than 0.02 μm.

12. The method of claim 1 in which the alkaline-earth metal borate is of the formula $MO.xB_2O_3$ in which M is an alkaline-earth metal and x is 0.5 to 3.

* * * * *